US005432961A

United States Patent [19]

Horton

[11] Patent Number: 5,432,961

[45] Date of Patent: Jul. 18, 1995

[54] LIFTING APPARATUS TO PROVIDE UNASSISTED POOL ACCESS FOR DISABLED PERSONS

[75] Inventor: Lowell C. Horton, Pensacola, Fla.

[73] Assignee: Clint Horton, II, Pensacola, Fla.

[21] Appl. No.: 986,719

[22] Filed: Dec. 8, 1992

[51] Int. Cl.[6] ..... E04H 4/14; A47K 3/12

[52] U.S. Cl. ..... 4/496; 4/562.1

[58] Field of Search ..... 4/494, 496, 560.1–566.1, 4/667; 414/921

[56] References Cited

U.S. PATENT DOCUMENTS

| | | | |
|---|---|---|---|
| 3,889,304 | 6/1975 | Loren | 4/563.1 |
| 4,183,106 | 1/1980 | Grimes et al. | 4/563.1 X |
| 4,571,758 | 2/1986 | Samuelsson | 4/460 X |
| 4,862,997 | 9/1989 | Eberle | 414/921 X |
| 4,941,216 | 7/1990 | Boublil | 4/496 |

FOREIGN PATENT DOCUMENTS

| | | | |
|---|---|---|---|
| 9210422 | 6/1992 | WIPO | 414/921 |

*Primary Examiner*—Robert M. Fetsuga

*Attorney, Agent, or Firm*—Davis C. Holden

[57] ABSTRACT

A lift device for providing unassisted, safe and easy access for disabled or injured persons to a swimming pool or other enclosures of water. The lift device comprises a base frame, a swing arm, an electrical motor for reversibly rotating the swing arm, a fixed housing, a moveable support structure, an electrical motor for moving the moveable support structure, and a carriage. The disabled or injured individual can activate the lift device by a movable pushbutton station, while seated in the carriage. Once the lift device is activated, the electrical motor for reversibly rotating the swing arm rotates the swing arm, roller support structure and translating support structure over the pool or other enclosure of water. At this point, the disabled or injured individual can activate the electrical motor for translating the translating support structure in order to lower the carriage into the pool. In order for the disable or injured individual to be removed from the pool, the aforementioned process is reversed by use of the movable pushbutton station.

3 Claims, 9 Drawing Sheets

LIFTING APPARATUS TO PROVIDE UNASSISTED POOL ACCESS FOR DISABLED PERSONS

BACKGROUND

1. Field of Invention

This invention relates in general to equipment used by disabled or injured persons, specifically to machines or devices that provide unassisted, safe and easy access for disabled or injured persons to a swimming pool or other enclosures of water.

BACKGROUND

2. Description of Prior Art

Persons with physical disabilities or injuries of various types often have difficulty getting into and out of swimming pools, bathtubs, and other enclosures of water. These persons typically require the assistance of other individuals. Even with the assistance of other individuals, the process of accessing a swimming pool is very difficult and can subject the disabled person to possible injury.

In response to the aforementioned difficulty, various devices have been patented assisting disabled or injured persons into and out of swimming pools or bathtubs. These devices nearly always require one operator and assistance in entering and leaving the water. For example, Moore U.S. Pat. No. 4,928,330, discloses an improved handicap bathtub lift. The lift is comprised of an adjustable upright post secured at the floor and ceiling with an extended arm pivotally secured to the upright post, which supports a chair member. The chair member can be raised and lowered into the bathtub through a threaded screw mechanism and a reversible electric motor. The chair member can also be manually pivoted from the loading area to the bathtub.

Boublil U.S. Pat. No. 4,941,216, discloses a device comprising a fixed support post, a rotation block, a guide column, or plate, and a rotation foot. The guide column comprises a fixed upright securing the front surface of the rotation block, a moving upright, and a vertical jack secured inside the fixed upright for moving the moving upright with respect to the fixed upright. A seat is secured to the moving upright. The rotation block includes a horizontal jack for pivoting the device. Tap water is supplied to the vertical and horizontal jacks to operate the device.

Luther U.S. Pat. No. 4,733,418 discloses an apparatus for assisting a handicapped or physically impaired person into and out of a bathing receptacle comprising a stanchion mounted independently of the receptacle, a seat which is pivotally attached to the stanchion, and a leg support. The stanchion contains a hydraulic cylinder for raising and lowering the seat. The seat is swingably mounted to move from a position beside the bathtub to a position over the bathtub.

Kuhlman U.S. Pat. No. 4,604,082 comprises a lift mechanism for transferring persons of limited mobility to and from a raised tub-like water treating facility. The mechanism includes a carriage rigidly mounted above the water treating facility, and slidably supported on a suitable track means which extends from the facility to the area adjacent to the facility. A hydraulic powered unit is coupled to the carriage for moving the carriage along the track means. A chair unit is secured to the movable element of an additional powered cylinder unit, which raises and lowers the chair unit with respect to the facility. Hydraulic fluid is used to power the cylinder units for the raising and lowering of the chair unit as well as to transverse the chair unit with respect to the bathtub.

Noland U.S. Pat. No. 4,221,008, discloses a device for transporting objects vertically and in a helical pattern, into and out of a pool of water. The device includes a carrier means, hydraulic cylinder means, and a guide means. The guide means is carried by the hydraulic cylinder, and adapted to follow a helical elongated cam means as the cylinder is moved vertically. Hydraulic fluid is supplied to the hydraulic cylinder means for lowering and raising the carrier means.

Grimes U.S. Pat. No. 4,183,106, discloses a device comprising a rotatable mounted frame, said frame rotation being powered by a hydraulic cylinder and gear mechanisms. A lift mechanism, connected to said rotable mounted frame, powered by a hydraulic lift motor.

Zillt U.S. Pat. No. 2,813,227, discloses an invalid hoist which includes a screw member for elevating a support arm which carries a carriage for the invalid. The screw member is driven by a water motor from a faucet adjacent to the invalid hoist. The carriage can be manually rotated into and out of position over the bathtub.

A common disadvantage of such prior art devices is that the disabled person cannot successfully utilize the devices without the assistance of another individual. For example, some of the prior art devices require the carriage member to be manually rotated from a position aside the swimming pool or bathtub to a position over the swimming pool or bathtub.

Another common disadvantage of the prior art devices is that installation requires such devices to be attached both at the floor and ceiling. Thus, the prior art devices are cumbersome to install and require more space for installation.

Another common disadvantage of some of the prior art devices is the use of water pressure to hydraulically activate such devices, therefore such devices are limited to the water pressure of available sources.

Another common disadvantage of the prior art devices that are powered hydraulically is that the movement of such devices is erratic and intermittent, not smooth and continuous.

Finally such prior art devices are unduly complex, and thus not cost effective.

OBJECT AND ADVANTAGES

One object of the invention is to provide a safe and easily operated pool access machine for the injured or disabled.

Another object is to allow the invention to be controlled by hand or remote by the disabled individual using the invention.

A further object of the invention is to provide for simple and convenient installation.

The invention is compact allowing it to be installed at convenient locations without the necessity of attachment to overhead structure.

Still another object is the ultra-quiet operation of the invention.

Yet, another object of the invention is to accommodate the attachment of a removable upright seat, a reclining stretcher, or a wheelchair carriage.

Yet another object is that the invention uses standard 110 volt power thus further allowing for convenient installation and utilization of conventional power resources.

A still further object of the invention is a lift device that can be easily adapted for industrial use, such a lifting applications for loading docks, warehouses and marine wharfs.

Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

DRAWING FIGURES

In the drawings, closely related figures have the same number but different alphabetic suffixes.

Figure 5B:
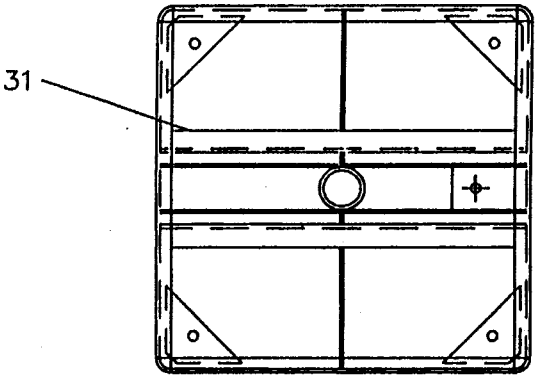
Figure 5C:
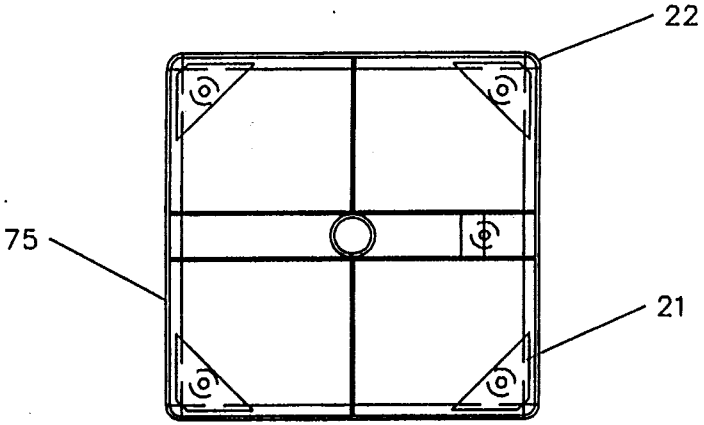
Figure 5A:
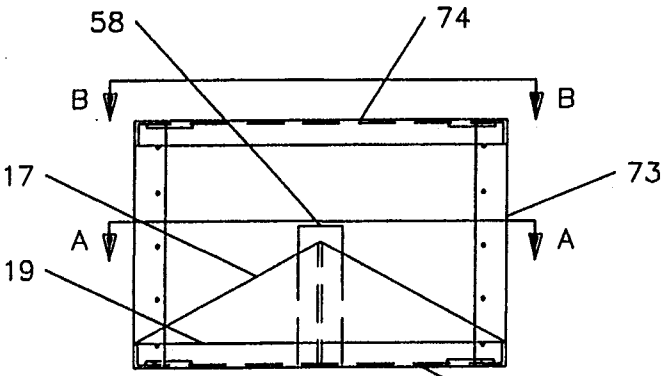

FIGS. 5*a* to 5*c* show various aspects of the base frame.

Figure 6:
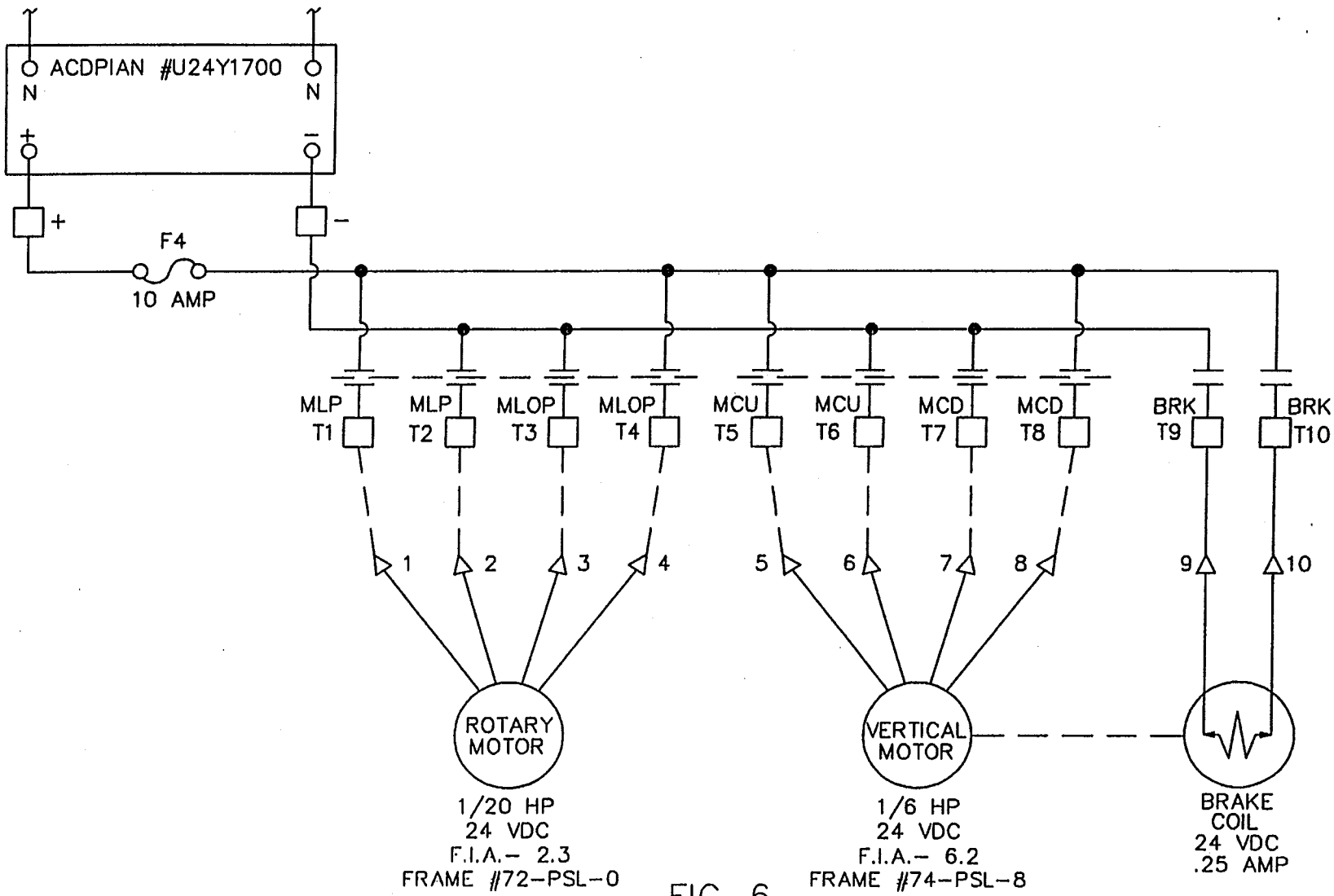

FIG. 6 is a power diagram for the device.

Figure 7:
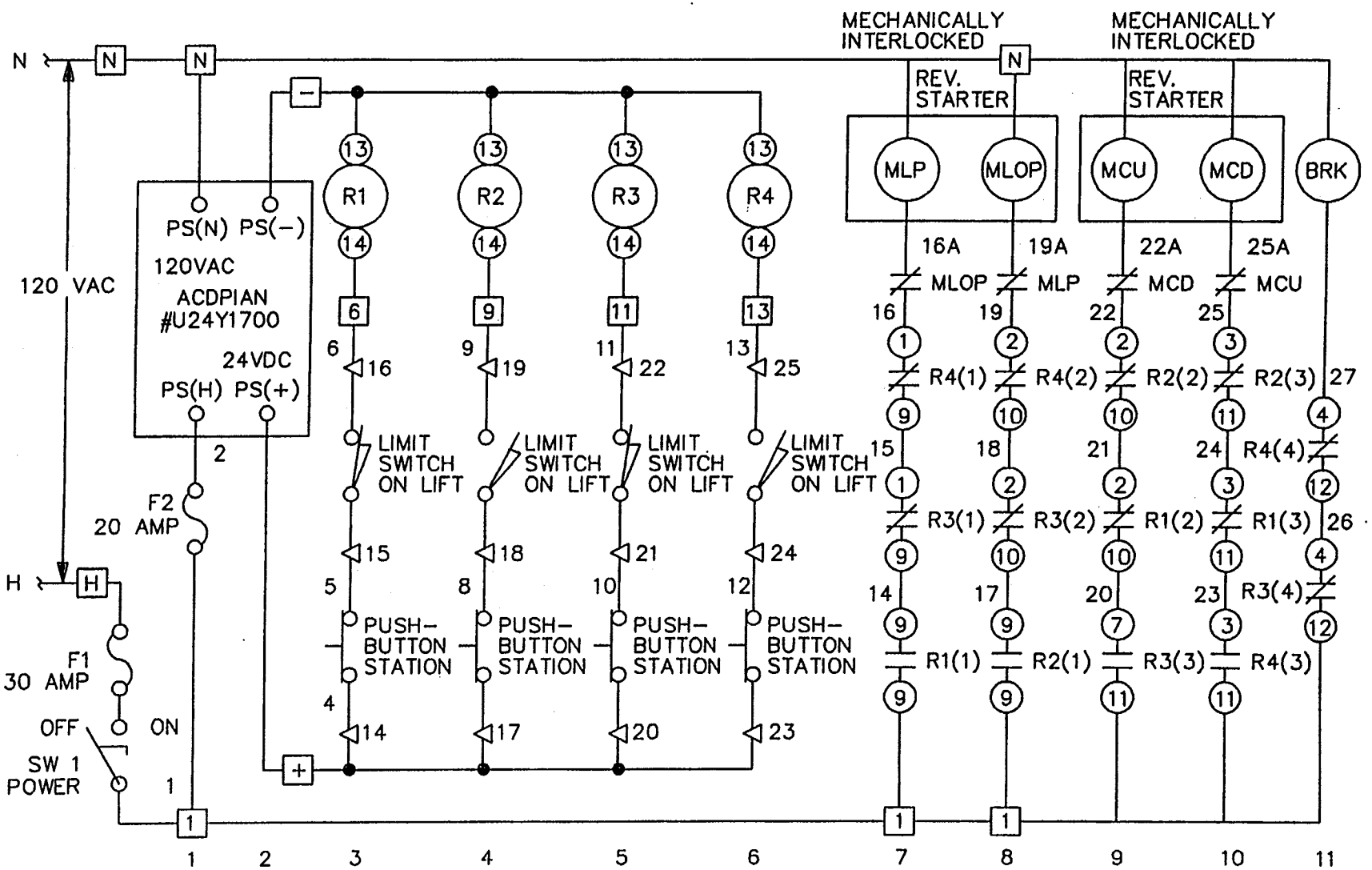

FIG. 7 is a electrical schematic for the device.

Figure 8:
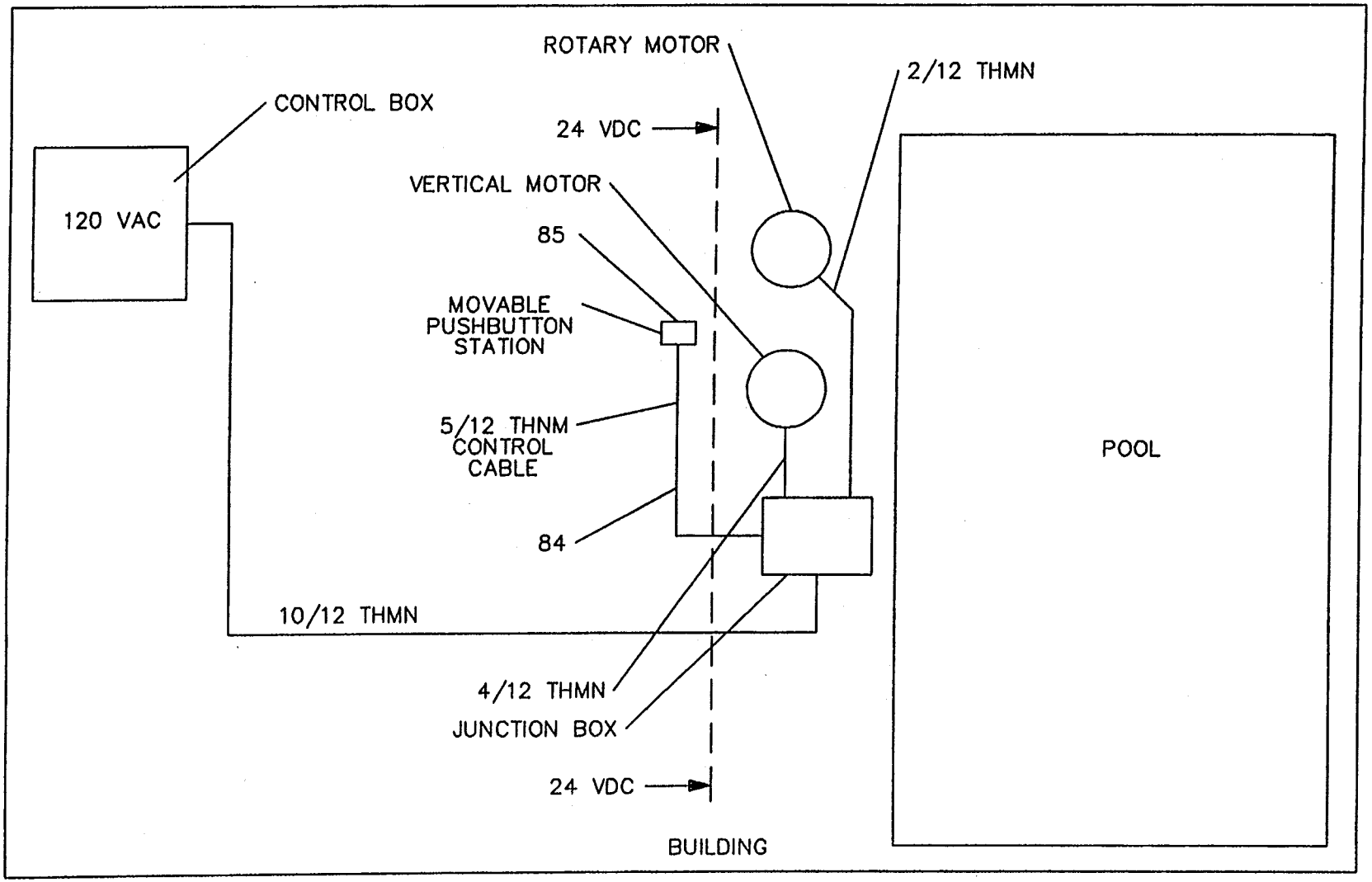

FIG. 8 is an electrical layout for the device.

Figure 1:
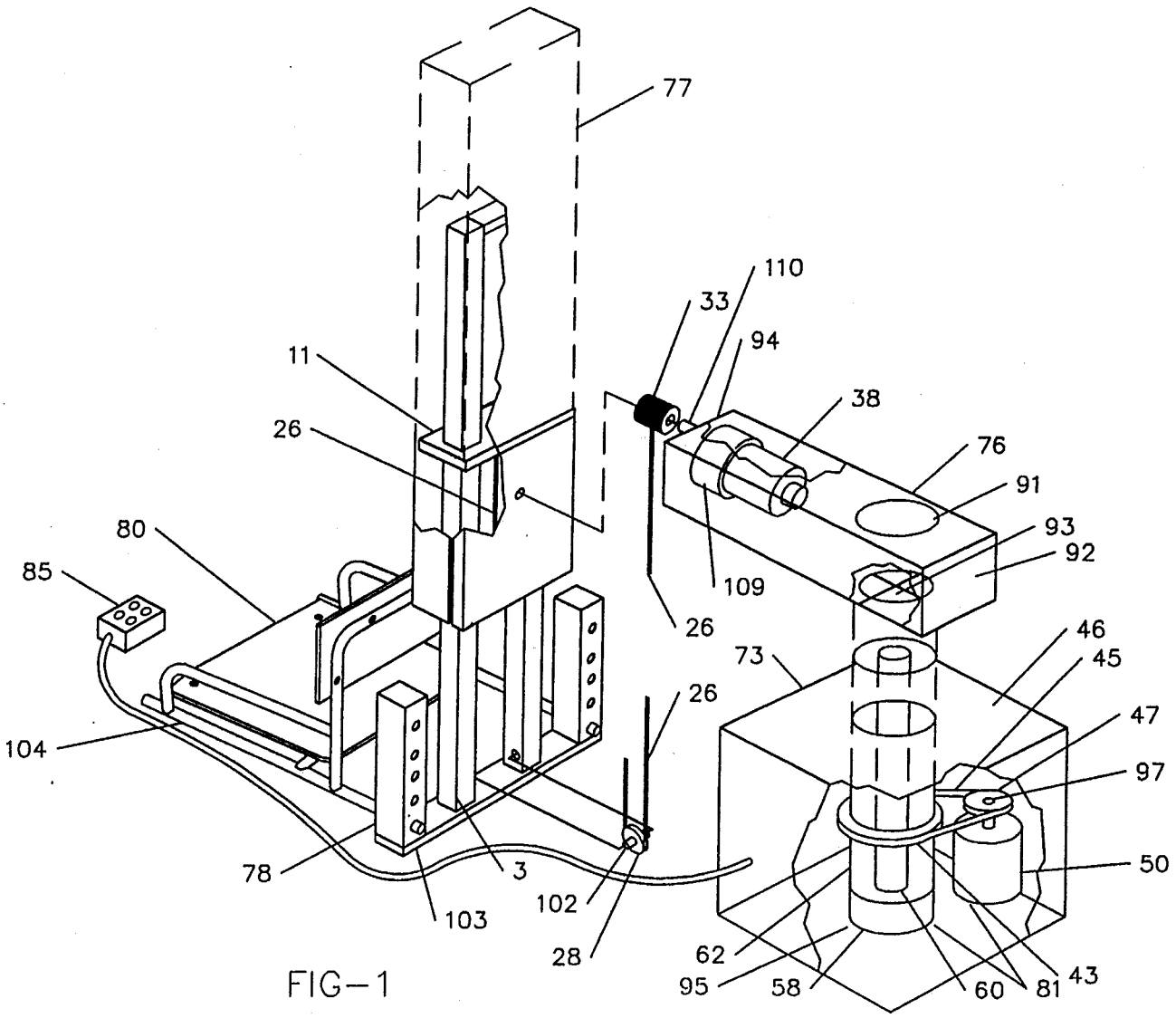
FIG. 1 is a exploded perspective view of the device according to the invention.
Figure 9:
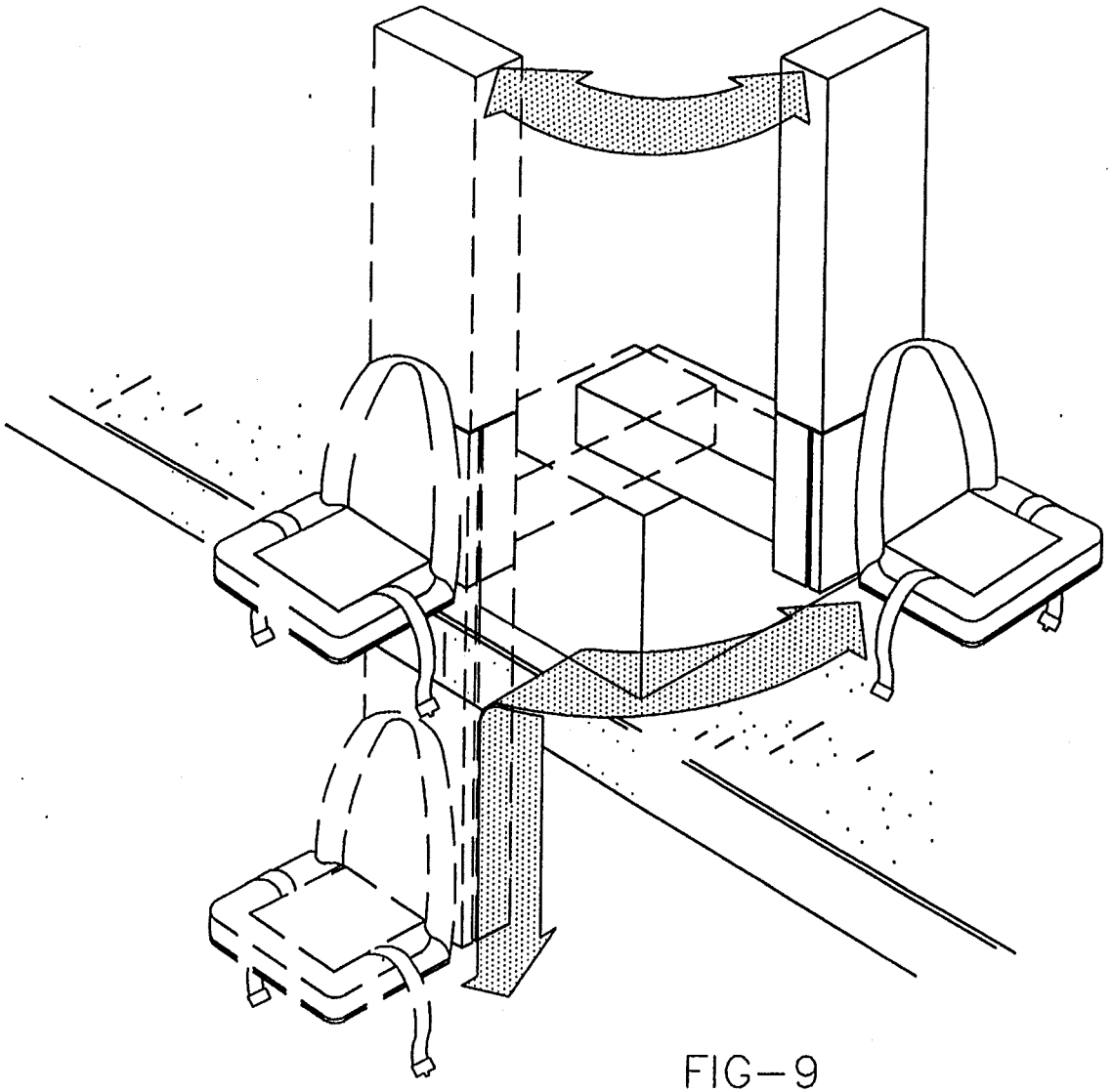

FIG. 9 is a perspective view of the device as shown in FIG. 1, indicating operational movement.

DESCRIPTION

Figure 2:
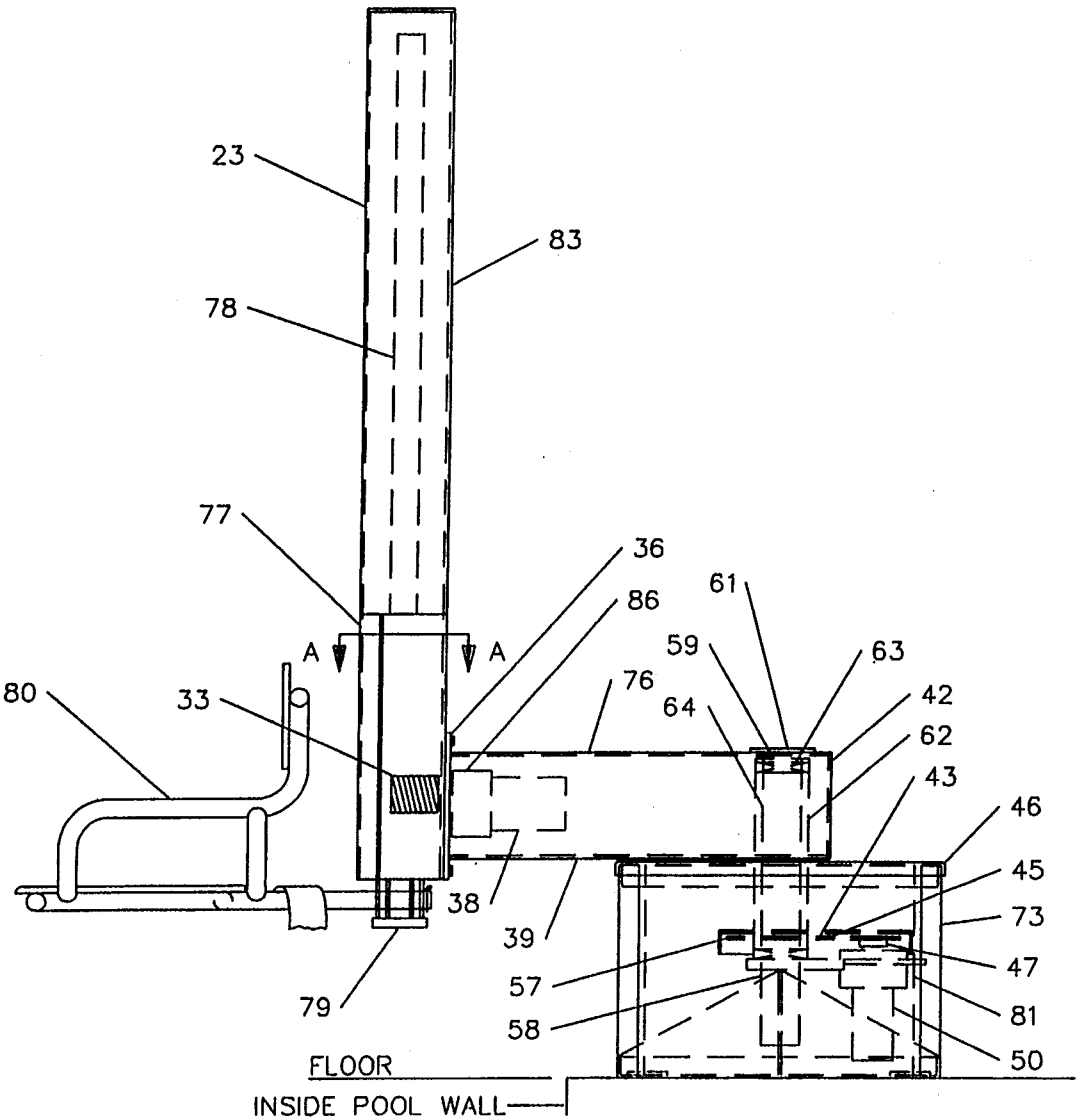
FIG. 2 is a side elevational view of the device of FIG. 1, with interior parts being shown by broken lines.

Referring now to the drawings, FIG. 1 and FIG. 2 show a typical embodiment of the lift device made in accordance with the present invention, and mounted on the floor adjacent to the inside pool wall. The lift device comprises a base frame, 73, a swing arm 76, an electrical means 81 for reversibly rotating swing arm 76, a fixed housing 77, a movable support structure 78, an electrical means 86 for reversibly moving movable support structure 78 and a carriage 80.

As shown in FIGS. 1, 2, 3, 4, and 5*a*–5*c*, base frame 73 is comprised of a top frame 74, a bottom frame 75, four corner braces 21, two top angled members 31, two right triangle gussets 14, two oblique triangle gussets 17, a top cover 46, and four outer covers 18. Base frame 73 is composed of a rectangular or square top frame 74 attached to a rectangular or square bottom frame 75, by four vertically disposed corner members 22. Top frame 74 and bottom frame 75 are each composed of four angled braces 19 arranged in a rectangular or square shape, and secured by four corner braces 21. Two top angled members 31 are attached between the front and back of top frame 74, being positioned equidistantly from the center of top frame 74. Top cover 46, having a circular hole 90 centered therein is attached to the top of base frame 73. Four outer covers 18 are attached to the four sides of base frame 73. Base frame 73, is secured to the deck surface adjacent to the inside pool wall by bolts or other fastener means.

Figure 3:
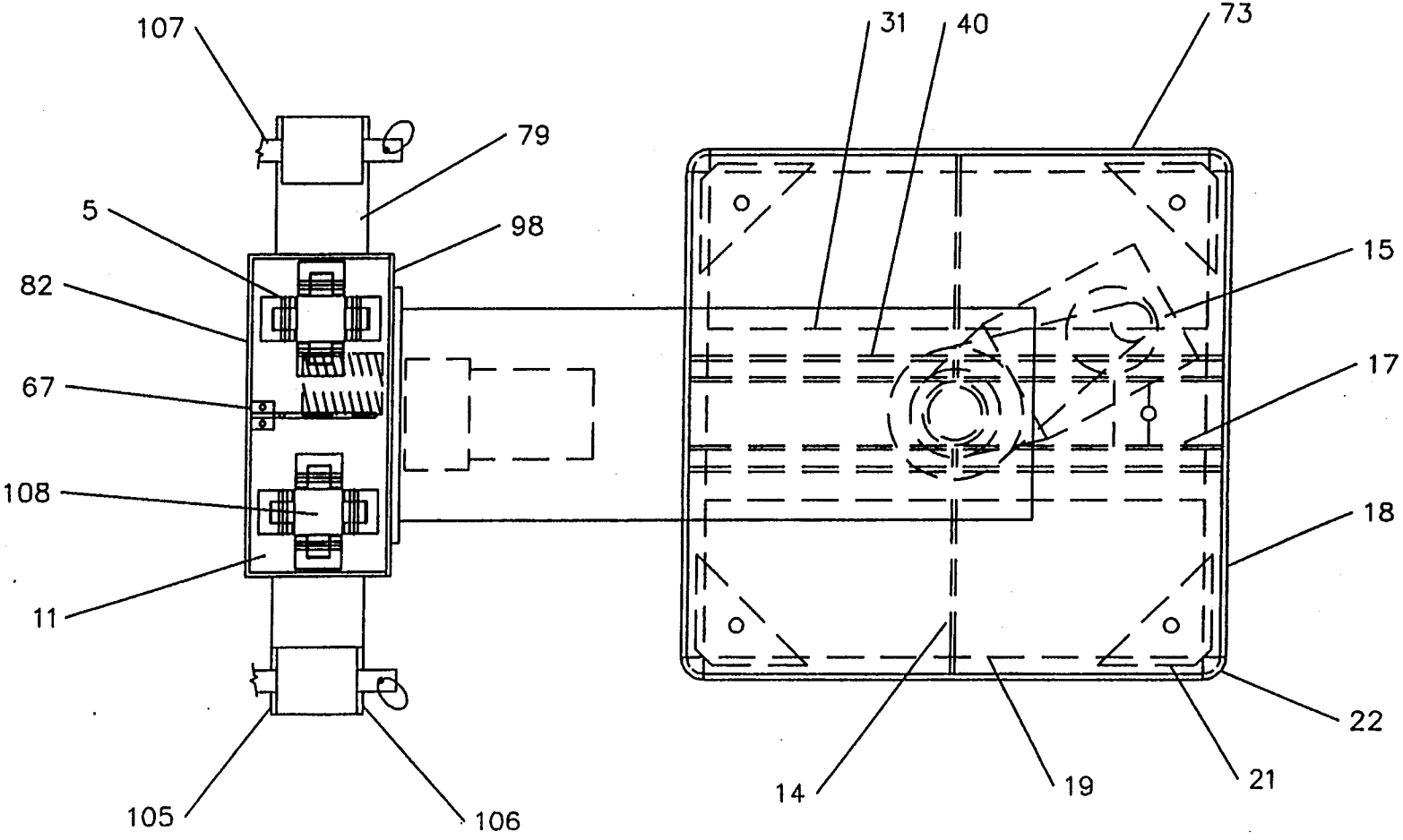
FIG. 3 is a top plan view of the device of FIG. 1, with interior parts being shown by broken lines.
Figure 4:
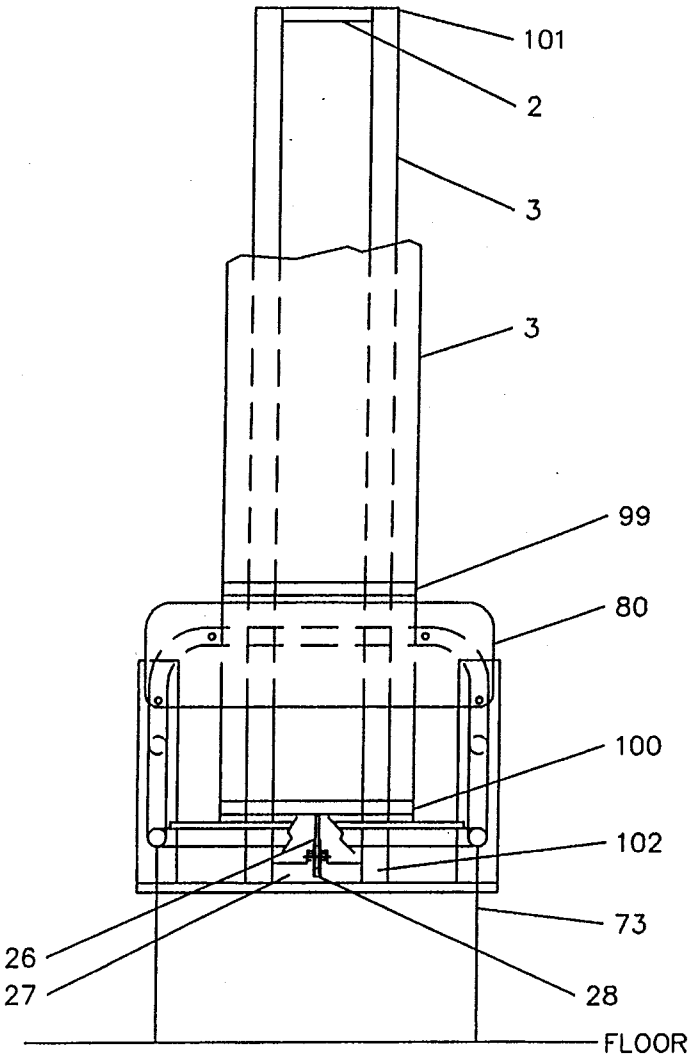
FIG. 4 is a front elevational view of the device of FIG. 1, with interior parts being shown by broken lines.

As shown in FIGS. 1, 2 and 3, swing arm 76 consists of an outer cover 41, a bottom plate 39, a back plate 42, an end plate 36, a circular cover plate 61, and two gussets 40. Outer cover 41 has a "U" shaped cross section and includes a circular hole 91 in the upper surface adjacent one end 92 of swing arm 76. Back plate 42 is attached to end 92 of swing arm 76. Bottom plate 39 which includes a circular hole 93 is attached to outer cover 41 such that circular hole 93 located in bottom plate 39 is in alignment with the vertical center line of circular hole 91 located in outer cover 41. End plate 36 is attached to the opposite end 94 of swing arm 76.

As shown in FIGS. 1, 2, and 3, an electrical means 81 for reversibly rotating swing arm 76, is composed of a drive shaft assembly 95, a motor base 15, a drive shaft sprocket 43, a reversible electric motor 50, an electric motor sprocket 47, and a roller chain 45.

Drive shaft assembly 95 is comprised of a lower pipe 58, an upper pipe 62, a drive shaft 60 and a lower bearing 57. Lower pipe 58 is positioned along the vertical center line of base frame 73 and is attached to base frame 73 by two right triangle gussets 14 and two oblique triangle gussets 17. Drive shaft 60 is vertically and rotatably disposed within lower pipe 58 and extends through the circular hole 90 in top cover 46. Upper pipe 62 is rotatably mounted around drive shaft 60 through lower bearing 57 inside the lower end 96 of upper pipe 62 and rotatably engaging drive shaft 60. Upper pipe 62 extends through circular hole 90 in top cover 46.

Motor base 15 is attached to lower pipe 58 by means of a socket head cap screw or other fastener. Reversible electric motor 50 is vertically disposed and attached to motor base 15 by bolts or other fastener means. Drive shaft sprocket 43 is positioned around the circumference of upper pipe 62. Electric motor sprocket 47 is attached to the shaft 97 of motor 50 by a key and socket set screw or other fastener means. Electric motor sprocket 47 is aligned on the shaft of motor 50 such that electric motor sprocket 47 is positioned in the same horizontal plane as drive shaft socket 43. Roller chain 45 is attached to electric motor sprocket 47 and drive shaft sprocket 43 in order to transmit power from reversible electric motor 50 to upper pipe 62.

Upper pipe 62 extends through the circular hole 93 in bottom plate 39 and is attached to the rim of the circular hole 91 in outer cover 41. A circular cover plate 61 is centered over the hole 91 in outer cover 41 and attached by flathead screws or other fasteners. Two gussets 40 are positioned inside swing arm 76 on opposing sides of the upper pipe 62 and attached to the interior surface of swing arm 76.

Both upper pipe 62 and drive shaft 60 are of sufficient length such that swing arm 76 can rotate freely across the surface of top cover 46.

As shown in FIGS. 1, 2, 3, and 4, fixed housing 77 is composed of a back channel 13, a back channel plate 82, two guide blocks 11, an upper front cover 23, and an upper back cover 83. Back channel 13, having a "U" shaped cross-section is attached to back channel plate 82 forming an assembly 98 with a square or rectangular cross-section. Two guide blocks 11, each having two rectangular holes 108 therein, are positioned horizontally and attached to the interior perimeter of assembly 98, first guide block 100 at the bottom of the assembly 98 and the second guide block 99 near the top of assembly 98. Two sets of four roller bearings 5 are attached to each guide block 11. Each set of four roller bearings 5 is positioned on guide block 11, such that support beam 3 can be rollably mounted therein. Upper front cover 23, is attached to upper back cover 83 and both upper front cover 23 and upper back cover 83 are attached to assembly 98.

Swing arm 76 is attached to fixed housing 77 at end plate 36 by four hexhead cap screws or other fastener means.

As shown in FIGS. 1, 2, 3, and 4, movable support structure 78 is comprised of two support beams 3, a spacer 2 and a carriage support member 79. Two support beams 3 are vertically aligned in a parallel fashion and disposed within two rectangular holes 108 in two guide blocks 11 and engaging two sets of roller bearings 5, so that two support beams 3 move vertically within the fixed housing 77. Two support beams 3 are attached at the upper terminal end 101 by spacer 2 and hexhead cap screws or other fastener means. Carriage support member 79 is attached to the lower terminal end 102 of two support beams 3 and is composed of a horizontal section 103 and two parallel vertical sections 104. Each vertical section 104 has a plurality of holes equally spaced along its front face 105 and extending through the back face 106.

Electrical means 86 for moving said movable support structure 78 is comprised of a reversible electric motor 38, a cable drum 33, a fully flexible cable 26, and a cable pulley 28. Reversible electric motor 38 is horizontally disposed within swing arm 76 and attached to end plate 36. A hole 109 in end plate 36 allows the drive shaft 110 of motor 38 to extend through end plate 36 in order to rotate freely.

Cable drum 33 is attached to drive shaft 110 of electric motor 38. Cable pulley 28 is attached to carriage support member 79 by dowel pin 102 and is located between support beams 3. Cable 26 is attached to cable drum 33 and extends from cable drum 33 downwardly to cable pulley 28, around cable pulley 28 and upwardly to guide block 99, which is attached near the upper end of movable support structure 78. Cable 26 is attached to guide block 99.

Carriage 80 suitable for supporting and carrying a disabled or injured person, is attached to carriage support member 79. Carriage 80 has two support rods 107 that are positioned in order to engage and extend through the plurality of holes in carriage support member 79. Carriage 80 is secured to carriage support member 79 by two lock pins 12 that are inserted in the end of two support rods 107. A stretcher or wheel chair lift can be attached in a similar fashion.

FIG. 7 shows an electrical schematic for the device whereby input of 120 volts alternating current is stepped down and transformed to 24 volts direct current. Thus, reversible electric motor 50 and reversible electric motor 38 can operate on 24 volts direct current.

FIG. 8 shows an electrical layout for the lift device, including a control cable 84 and a movable pushbutton station 85. Movable pushbutton station 85 allows the disabled individual to operate the device while positioned in carriage 80.

OPERATION

The manner of using the disclosed device is both simple and convenient. As shown in FIG. 1, a disabled or injured individual is placed in carriage 80. By means of movable pushbutton station 85 reversible electric motor 50 is activated by the disabled individual, whereby roller chain 45 applies torque to upper pipe 62. As a result of the applied torque, upper pipe 62 rotates swing arm 76 in the activated direction. Swing arm 76 continues to rotate until carriage 80 is located in the appropriate position over the body of water. Once carriage 80 is in the appropriate position, the disabled person uses movable pushbutton station 85 to deactivate reversible electric motor 50.

In order to lower the disabled individual, reversible electric motor 38 is then activated. Motor 38 rotates cable drum 33 in the direction that dispenses cable 26. As cable 26 is dispensed from cable drum 33, pulley 28 rotates, thereby allowing movable support structure 78 to translate in a direction towards the body of water. Once carriage 80 has reached the appropriate position in the pool or other body of water, the disabled person uses moveable pushbutton station 85 to deactivate motor 38.

In order to remove the disabled individual from the water, the disabled individual is first placed in carriage 80. Reversible electric motor 38 is then activated in order to retrieve cable 26. Reversible electric motor 38 rotates cable drum 33 thereby retrieving cable 26 as cable 26 is wrapped around the cable drum 33. As cable 26 is retrieved, cable pulley 28 rotates and applies an upward load to moveable support structure 78.

As a result of the rotation of pulley 28 and the load applied to movable support structure 78, moveable support structure 78 translates in an upward direction. Once carriage 80 has reached the appropriate position above the pool or other body of water, reversible electric motor 38 is deactivated by moveable pushbutton station 85.

In order to move the disabled individual from a position above the pool or other body of water to a position over the floor surface adjacent the pool, reversible electric motor 50 is activated. As described above, swing arm 76 is rotated via roller chain 45, drive shaft sprocket 43, electric motor sprocket 47, and upper pipe 62. When the disabled individual is positioned above the floor surface, reversible electric 50 motor is deactivated. At this point, the disabled individual can be removed from carriage 80.

Although the description above contains many specificities, these should not be construed as limiting the scope of the invention but as merely providing illustrations of the presently preferred embodiment of this invention. For example, base frame 73, swing arm 76 fixed housing 77 can have other shapes, such as circular, oval, trapezoidal or triangular.

Thus the scope of the invention should be determined by the appended claims and their legal equivalents, rather than by the examples given.

What is claimed:

1. A lift device for providing access to an enclosure of water for disabled individuals, comprising:

(a) a base frame;

(b) a swing arm rotatably attached to said base frame;

(c) means, attached to said base frame for reversibly rotating said swing arm;

(d) a fixed housing, having two sets of four roller bearings therein, attached to said swing arm;

(e) a moveable support structure rollably attached to said fixed housing by said sets of four roller bearings, wherein said moveable support structure comprises at least two support beams vertically disposed in a parallel manner and rollably attached to said fixed housing by engaging said sets of four roller bearings, a spacer attached at the top of said support beams for securing said support beams in a parallel fashion, and a carriage support member attached to the lower terminal end of said support beams, said carriage support member being composed of a horizontal section and two parallel vertical sections;

(f) means, attached to said swing arm for reversibly moving said moveable support structure within said fixed housing; and (g) a carriage attached to said moveable support structure.

2. A lift device for providing access to an enclosure of water for disabled individuals, comprising:

(a) a base frame;

(b) a swing arm rotatably attached to said base frame;

(c) a first reversible electric motor attached to said base frame;

(d) means, rotatably attached to said base frame and fixed to said swing arm for transmitting rotational power from said first reversible electric motor to said swing arm;

(e) a fixed housing, having two sets of four roller bearings therein, attached to said swing arm;

(f) a moveable support structure rollably attached to said fixed housing by said sets of four roller bearings, wherein said moveable support structure comprises at least two support beams vertically disposed in a parallel manner and rollably attached to said fixed housing by engaging said sets of four roller bearings, a spacer attached at the top of said support beams for securing said support beams in a parallel fashion, and a carriage support member attached to the lower terminal end of said support beams, said carriage support member being composed of a horizontal section and two parallel vertical sections;

(g) a second reversible electric motor attached to said swing arm;

(h) means, attached to said second reversible electric motor, said moveable support structure, and said fixed housing for moving said moveable support structure within said fixed housing; and (i) a carriage attached to said moveable support structure;

(g) a carriage attached to said moveable support structure.

3. A lift device for providing access to an enclosure of water for disabled individuals, comprising:

(a) a base frame, wherein said base frame includes, a top frame, composed of a first set of four angled braces secured together in a rectangular shape by a first set of four corner braces, a bottom frame composed of a second set of four angled braces secured together in a rectangular shape by a second set of four corner braces, two top angled members attached between opposing sides of said top frame and being positioned equidistantly from the center of said top frame, a lower pipe vertically disposed within said base frame and attached to said bottom frame by two right triangle gussets and two oblique triangle gussets, a top cover attached to said top frame and having a hole centered therein, four outer covers attached to opposing sides of said base frame, and four corner members, each corner member vertically disposed and attached to said top frame and said bottom frame to form a box structure;

(b) a swing arm rotatably attached to said base frame, wherein said swing arm includes, an outer cover having a "U" shaped, horizontal cross-section and having a hole near one end of said outer cover, a bottom plate attached to the terminal ends of said outer cover and having a hole with a center-line in vertical alignment with the hole in said outer cover, a back plate attached to the end of said swing arm adjacent the hole in said outer cover and the hole in said bottom plate, an end plate having a hole therein and attached to the end of said swing arm opposite said back plate, and two gussets positioned inside said swing arm and attached to said swing arm on opposing sides of the hole in said bottom plate;

(c) means, attached to said base frame for reversibly rotating said swing arm, wherein said means includes, a drive shaft, vertically and rotatably disposed within said lower pipe and extending through the hole in said top cover, an upper pipe, rotatably mounted around said drive shaft through a lower bearing located inside a lower end of said upper pipe, said lower bearing rotatably engaging said drive shaft, a drive shaft sprocket positioned around the circumference of said upper pipe, a motor base attached to an upper end of said lower pipe, a first reversible electric motor, vertically disposed and attached to the under side of said motor base, an electric motor sprocket attached to a motor shaft of said first reversible electric motor, and a roller chain attached to said electric motor sprocket and said drive shaft sprocket;

(d) a fixed housing, attached to said swing arm, wherein said fixed housing includes, a back channel having a "U" shaped horizontal cross-section, a back channel plate attached to the terminal ends of said back channel, at least two guide blocks, each of said guide blocks having at least one hole therein, said guide blocks positioned horizontally and attached to the interior perimeter of said back channel and said back channel plate, and at least two sets of four roller bearings attached to said guide blocks, with each of said sets of four roller bearings positioned to surround one hole in said guide block;

(e) a moveable support structure rollably attached to said fixed housing by said sets of four roller bearings, wherein said moveable support structure includes, at least two support beams vertically disposed in a parallel manner and rollably attached to said fixed housing by engaging said sets of four roller bearings and extending through said holes in said guide blocks, a spacer attached at the top of said support beams for securing said support beams in a parallel fashion, and a carriage support member attached to the lower terminal end of said support beams, said carriage support member being composed of a horizontal section and two parallel vertical sections, each of said vertical sections having a plurality of holes equally spaced along the front face and extending through the back face of said vertical sections;

(f) means, attached to said swing arm for reversibly moving said moveable support structure within said fixed housing, wherein said reversibly moving means includes, a second reversible electric motor horizontally disposed within said swing arm and attached to said swing arm, a drive shaft of said second reversible electric motor extending through said end plate of swing arm, and into the interior of said fixed housing, a cable drum attached to said drive shaft of said second reversible electric motor, a cable pulley attached to said carriage support member and disposed between said support beams, and a fully flexible cable attached to said cable drum, extending from said cable drum downwardly to said cable pulley, around said cable pulley, and extending upwardly to, and attached to said guide block, which is attached near the upper end of said fixed housing; and (g) a carriage attached to said moveable support structure.

* * * * *